US009144725B2

(12) United States Patent
Hocknell et al.

(10) Patent No.: US 9,144,725 B2
(45) **Date of Patent: *Sep. 29, 2015**

(54) PUTTER FACE INSERT

(71) Applicant: CALLAWAY GOLF COMPANY, Carlsbad, CA (US)

(72) Inventors: Alan Hocknell, Encinitas, CA (US); Craig E. Abbott, Vista, CA (US); Augustin W. Rollinson, Carlsbad, CA (US)

(73) Assignee: CALLAWAY GOLF COMPANY, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/528,258

(22) Filed: Oct. 30, 2014

(65) Prior Publication Data

US 2015/0057099 A1 Feb. 26, 2015

Related U.S. Application Data

(63) Continuation of application No. 14/205,991, filed on Mar. 12, 2014, now Pat. No. 8,915,798, which is a continuation of application No. 13/797,666, filed on Mar. 12, 2013, now Pat. No. 8,696,492, which is a continuation-in-part of application No. 13/445,757, filed on Apr. 12, 2012, now Pat. No. 8,684,860, which is a continuation-in-part of application No. 29/414,722, filed on Mar. 2, 2012, now Pat. No. Des. 672,418.

(60) Provisional application No. 61/609,737, filed on Mar. 12, 2012.

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01); *A63B 53/04* (2013.01); *A63B 53/047* (2013.01); *A63B 53/0466* (2013.01); *A63B 53/0475* (2013.01); *A63B 2053/042* (2013.01); *A63B 2053/0408* (2013.01); *A63B 2053/0416* (2013.01); *A63B 2053/0425* (2013.01); *A63B 2053/0429* (2013.01); *A63B 2053/0445* (2013.01); *A63B 2053/0458* (2013.01); *A63B 2209/00* (2013.01); *A63B 2209/10* (2013.01)

(58) Field of Classification Search
CPC ..... A63B 2053/0429; A63B 2053/0425; A63B 2053/042; A63B 2053/0416; A63B 53/007; A63B 53/0487; A63B 53/0466; A63B 53/047
USPC ..... 473/342, 329, 340, 348, 349
See application file for complete search history.

(56) References Cited

U.S. PATENT DOCUMENTS

| | | | | |
|---|---|---|---|---|
| 1,968,092 | A * | 7/1934 | Oldham | 473/342 |
| 2,429,351 | A * | 10/1947 | Fetterolf | 473/329 |
| 3,695,618 | A * | 10/1972 | Woolley et al. | 473/342 |
| 6,699,140 | B1 * | 3/2004 | Sun | 473/252 |
| 7,914,394 | B2 * | 3/2011 | Cole et al. | 473/332 |
| 8,915,798 | B2 * | 12/2014 | Hocknell et al. | 473/342 |
| 2004/0009829 | A1 * | 1/2004 | Kapilow | 473/342 |
| 2005/0020378 | A1 * | 1/2005 | Krumme et al. | 473/332 |

* cited by examiner

*Primary Examiner* — Benjamin Layno
(74) *Attorney, Agent, or Firm* — Rebecca Hanovice; Michael A. Catania; Sonia Lari

(57) ABSTRACT

A putter-type golf club head having a face insert comprising a metal sheet and a urethane backing is disclosed herein. The metal sheet, which makes contact with a golf ball during use, includes a plurality of oval-shaped holes extending through the entire thickness of the sheet and having a specific size and spacing, and the urethane backing has a hardness that optimizes performance of the face insert, and thus the putter.

16 Claims, 4 Drawing Sheets

PUTTER FACE INSERT

CROSS REFERENCES TO RELATED APPLICATIONS

The present application is a continuation of U.S. patent application Ser. No. 14/205,991, filed on Mar. 12, 2014, and issued as U.S. Pat. No. 8,915,798 on Dec. 23, 2014, which is a continuation of U.S. patent application Ser. No. 13/797,666, filed on Mar. 12, 2013, and issued as U.S. Pat. No. 8,696,492 on Apr. 15, 2014, which is a continuation-in-part of U.S. patent application Ser. No. 13/445,757, filed on Apr. 12, 2012, and issued as U.S. Pat. No. 8,684,860 on Apr. 1, 2014, which is a continuation-in-part of and claims priority to U.S. Design patent application No. 29/414,722, filed on Mar. 2, 2012, which issued as U.S. Design Pat. No. D672,418 on Dec. 11, 2012, and also claims priority to U.S. Provisional Patent Application No. 61/609,737, filed on Mar. 12, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club face insert. More specifically, the present invention relates to a face insert for putter-type golf club heads having improved feel and performance qualities.

2. Description of the Related Art

The prior art discloses many different types of golf club heads, especially putter-type golf club heads. Although these inventions have disclosed various types of face inserts for said putter-type golf club heads, the prior art has not provided an optimized face insert that provides improved feedback and feel during putting combined with improved performance.

BRIEF SUMMARY OF THE INVENTION

The present invention provides a novel face insert that optimizes putter performance. For example, one aspect of the present invention is a golf club face insert comprising a sheet comprising a front surface, a back surface, and a plurality of holes extending through the sheet from the front surface to the back surface, and a backing composed of a polymer material, wherein the sheet is permanently attached to the polymer backing. In some embodiments, each of the holes may have an oval shape, and may further have a width of 0.150 inch to 0.200 inch and a height of 0.020 to 0.060 inch, and more specifically may have a width of approximately 0.180 inch and a height of approximately 0.040 inch. In some embodiments, the sheet may have a thickness of no less than 0.005 inch and no more than 0.100 inch, and more specifically a thickness of no less than 0.007 inch and no more than 0.016 inch. In other embodiments, the sheet may be attached to the backing with an adhesive material. In some embodiments, the backing may be composed of a urethane, which may have a hardness of Shore 40D to Shore 60D. In some embodiments, the backing may have a thickness of no less than 0.100 inch and no more than 0.300 inch, and more specifically a thickness of approximately 0.200 inch.

Another aspect of the present invention is a golf club head comprising a body comprising a top surface, a bottom surface, a heel side, a toe side, and a face recess, and a face insert comprising a sheet and a urethane backing, wherein the sheet comprises a plurality of holes that extend from a front surface to a back surface of the sheet, wherein the face insert is sized to fit within the face recess, and wherein the face insert is secured within the face recess with an adhesive material. In some embodiments, the golf club head may be a putter-type head. In other embodiments, the urethane backing may have a hardness of Shore 40D to Shore 60D, and the sheet may be composed of a metal material, such as a steel, titanium, aluminum, or nickel titanium material. In some embodiments, each of the plurality of holes may have an oval shape, and further may have a width of 0.150 inch to 0.200 inch and a height of 0.020 to 0.060 inch. In further embodiments, each of the plurality of holes may be spaced horizontally from neighboring holes by 0.01 to 0.03 inch, and each of the plurality of holes may be spaced vertically from neighboring holes by 0.005 to 0.011 inch. In still further embodiments, each of the plurality of holes may be spaced horizontally from neighboring holes by approximately 0.026 inch, and each of the plurality of holes may be spaced vertically from neighboring holes by approximately 0.009 inch.

Yet another aspect of the present invention is a putter comprising a head comprising a top surface, a bottom surface, a heel end, a toe end, and a face comprising a face recess, a face insert comprising a metal sheet having a plurality of oval-shaped holes that extend completely through the sheet and a urethane backing having a hardness of Shore 42D, and a shaft, wherein the metal sheet is affixed to the urethane backing with an adhesive material, wherein the face insert is sized to fit within the face recess, wherein the face insert is retained within the face recess with an adhesive material, wherein the metal sheet has a thickness of no less than 0.007 inch and no more than 0.016 inch, and wherein the urethane backing has a thickness of no less than 0.100 inch and no more than 0.300 inch. In some embodiments, each of the plurality of holes may have a width of 0.150 inch to 0.200 inch and a height of 0.020 to 0.060 inch, each of the plurality of holes may be spaced horizontally from neighboring holes by 0.01 to 0.03 inch, and each of the plurality of holes may be spaced vertically from neighboring holes by 0.005 to 0.011 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to an improved face insert for use in golf club heads, particularly putters, though it may be used in connection with wood-type golf club heads like fairways, drivers, and hybrids, as well as with iron-type golf club heads.

Figure 1:
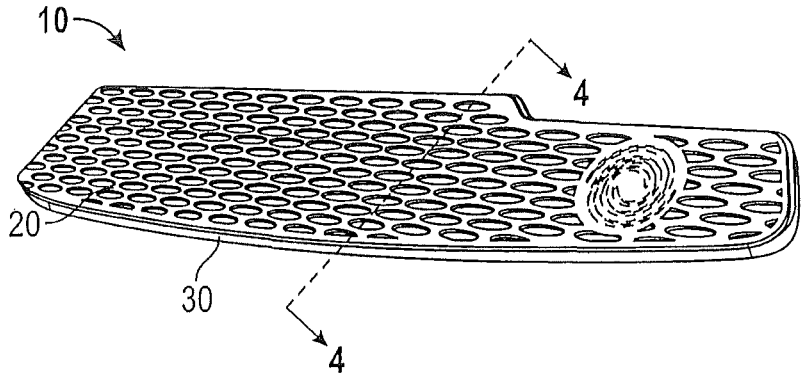
FIG. 1 is a front perspective view of a first embodiment of the present invention.
Figure 4:
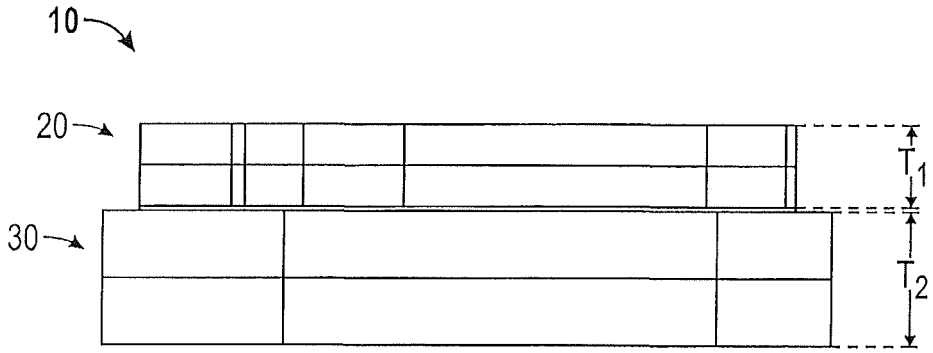
FIG. 4 is a cross-sectional of the embodiment shown in FIG. 1 along lines 4-4.

In a first embodiment, shown in FIGS. 1 and 4, the face insert 10 comprises a metal striking sheet 20, which is preferably composed of 6061 aluminum, and a polymeric backing 30, which is preferably composed of a urethane having a hardness of Shore 40D to 60D. The metal sheet 20, which is designed to make contact with and grip a golf ball, includes a textured surface 22 composed of a plurality of oval-shaped holes 24 that are stamped into the metal sheet 20, the edges of which are then machined to achieve sharpness. The holes 24 in this embodiment do not extend through the entire thickness $T_1$ of the metal sheet 20, but in an alternative embodiment, disclosed herein, they may do so. In alternative embodiments of the present invention, the striking sheet 20 may be made of any metal material that has similar properties to 6061 aluminum, or out of titanium, stainless steel, or a hard plastic, and the holes 24 may be machined into the sheet 20 instead of stamped. In these alternative embodiments, the holes 24 may have one or more different, geometric shapes.

Figure 2A:
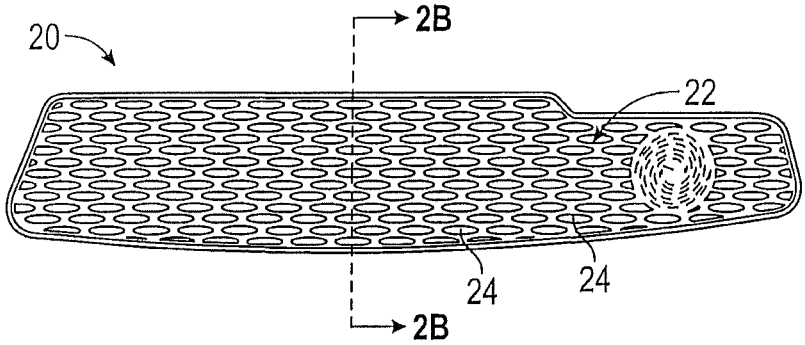
FIG. 2A is a front plan view of part of the embodiment shown in FIG. 1.
Figure 2B:
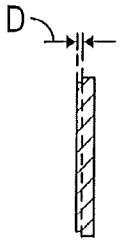
FIG. 2B is a cross-sectional view of the embodiment shown in FIG. 2A along lines 2B-2B.
Figure 2C:
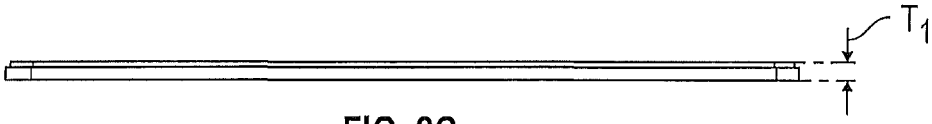
FIG. 2C is a bottom plan view of the embodiment shown in FIG. 2A.
Figure 3:
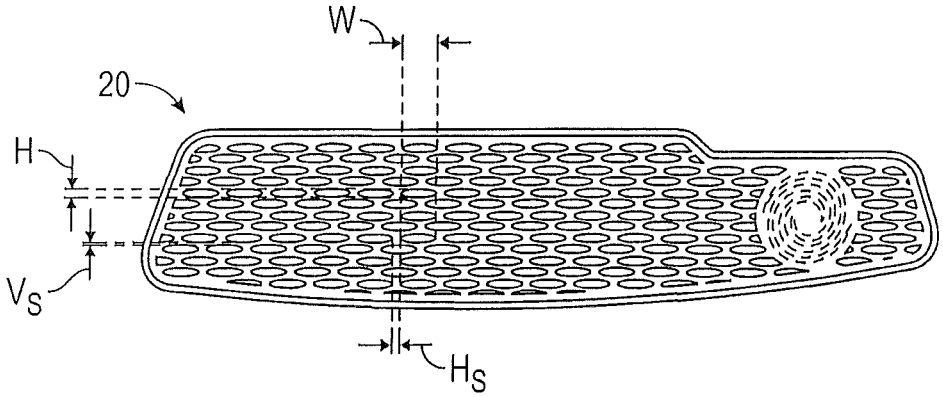
FIG. 3 is another front plan view of the part of the embodiment shown in FIG. 2A.

The specific dimensions of the metal sheet 20, including the holes 24, allow the face insert 10 to grip the surface of a golf ball. As shown in FIGS. 2B-3, in the preferred embodiment, the metal sheet 20 has a thickness $T_1$ of 0.050 inch to 0.100 inch, more preferably 0.075 inch, while the holes 24 have a depth D of 0.005 inch to 0.015 inch, more preferably 0.012 inch, a height H of 0.020 to 0.060 inch, more preferably 0.040 inch, and width W of 0.150 inch to 0.200 inch, more preferably 0.180 inch. To maximize the gripping effect, the holes 24 have vertical spacing Vs from each other of 0.005 to 0.011 inch, more preferably 0.009 inch, and horizontal spacing Hs of 0.01 to 0.03 inch, more preferably 0.026 inch.

While the metal sheet 20 makes contact with and grips the golf ball, the backing 30 absorbs the force of contact with a golf ball, allowing for the ball to make longer contact with the metal sheet 20 portion of the face insert 10 and providing desired performance characteristics. To maximize the absorption of the force of impact with a golf ball, the backing 30 preferably has a thickness $T_2$ of 0.100 to 0.150 inch, and more preferably a thickness of approximately 0.120 inch. Though the preferred embodiment of the backing 30 is composed of a urethane material having a hardness of Shore 60D, in alternative embodiments the backing may be composed of non-metal materials having similar performance characteristics. In some embodiments, the backing 30 may be composed of materials having a hardness of Shore 40D-55D, which yield slower ball speed.

Figure 5:
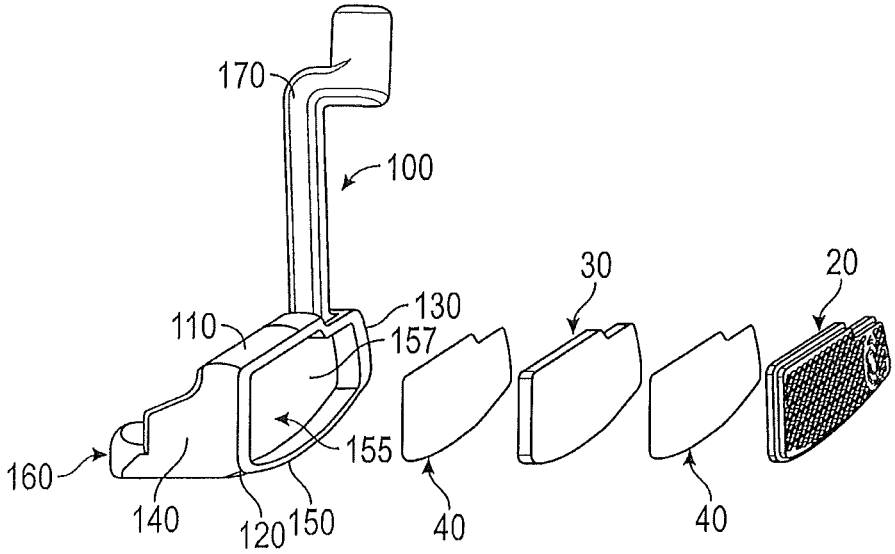
FIG. 5 is an exploded perspective view of the embodiment shown in FIG. 1 in combination with an exemplary golf club head.

FIG. 5 shows an exemplary putter head 100 into which the face insert 10 of the present invention can be inserted. The putter head 100 includes a top surface, a bottom surface 120, a heel side 130, a toe side 140, a face portion 150 including a recess 155, a rear portion 160, and a hosel 170. The metal sheet 20 is bonded to the backing 30 with an adhesive 40 that is evenly applied over a back surface of the metal sheet 20, and then the backing 30 is bonded to a bottom surface 157 of the recess 155 with an adhesive 40.

The particular dimensions and materials disclosed herein with respect to the first embodiment of the present invention provide a golf club containing this face insert 10 with more control over the golf ball's spin than prior art clubs. Testing was performed using the putter head 100 shown in FIG. 5, which includes the preferred embodiment of the present invention, and two commercially available putter products. A golfer hit five putts with each putter and the results of these hits were measured and analyzed. As shown in Table 1 below, though Commercial Product 1 produced more top spin, it also launched the ball at an undesirably high angle, which caused the ball to bounce. While Commercial Product 2 launched the golf ball at a lower angle than Commercial Product 1, it created an undesirably low spin rate. The putter head including the preferred embodiment of the present invention produced more top spin that Commercial Product 2 and a launched the golf ball at a much lower angle than both Commercial Products, causing less bounce than both of these clubs and a more constant deceleration of the golf ball during its skid phase. This, in turn, produced a smoother and more consistent roll in both appearance and distance control.

TABLE 1

| Golf Club | Ball Speed | Launch Angle | Spin Rate |
|---|---|---|---|
| Preferred embodiment | 5.62 mph | 2.34° | 48.73 rpm |
| Commercial Product 1 | 5.47 mph | 4.20° | 86.76 rpm |
| Commercial Product 2 | 5.85 mph | 3.16° | 33.83 rpm |

Figure 6:
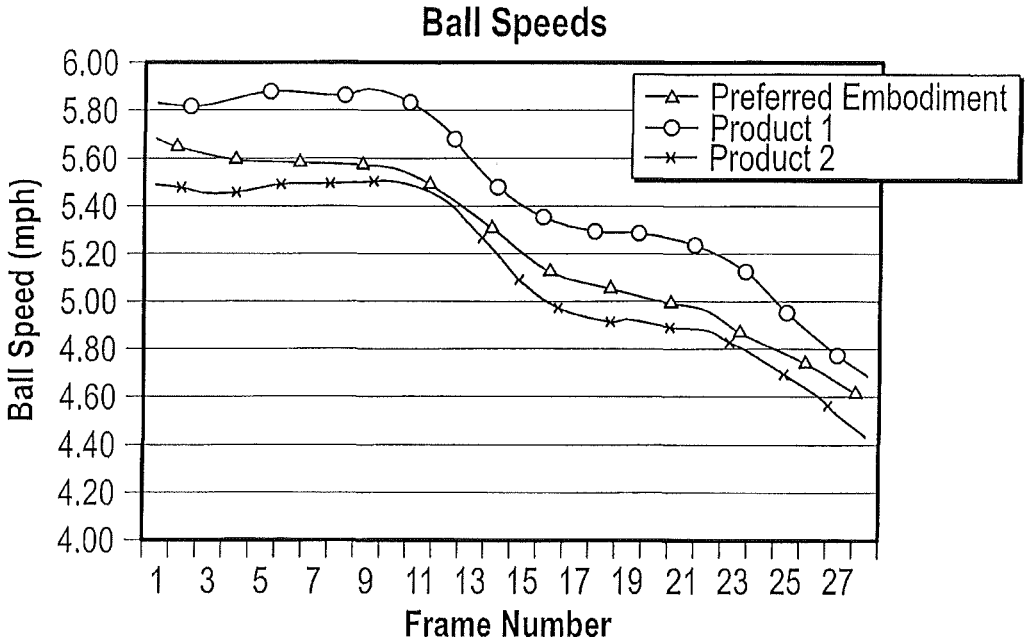
FIG. 6 is a graph comparing ball speeds imparted by the embodiment shown in FIG. 5 with ball speeds imparted by other commercial putters.

The deceleration of golf balls hit by each golf club in Table 1 was also analyzed, as shown in FIG. 6. The speed deceleration of a golf ball struck by the putter head 100 shown in FIG. 5 was more constant, and resulted in a flatter line in the plotted graph of FIG. 6 than the other two putters. This due to the combination of a lower launch angle with the right amount of top spin, which minimized bouncing and produced more consistent deceleration and thus a smoother, more consistent roll.

In another test, the spin of golf balls hit at different head speeds, which are representative of different putting distances, was measured using a putter including a face having the preferred embodiment of the present invention and a putter having a smooth face. Launch angles were also measured for each club and each head speed. As shown in Table 2, the preferred embodiment of the invention causes golf balls to launch at lower angles and with more top spin than the traditional, smooth-faced putter, thus providing a golfer with more control over the ball.

TABLE 2

| Golf Club Face | Measurement | 4.5 mph (3.5 foot putt) | 6 mph (8 foot putt) | 7.5 mph (20 foot putt) |
|---|---|---|---|---|
| Smooth | Spin (rpm) | 8.76 | 0.27 | −7.12 |
| | Launch (deg) | 3.27 | 3.19 | 2.91 |
| | Ball Speed (mph) | 4.48 | 5.589 | 7.78 |
| Preferred Embodiment | Spin (rpm) | 16.52 | 10.00 | 11.08 |
| | Launch (deg) | 3.26 | 2.74 | 2.26 |
| | Ball Speed (mph) | 4.39 | 5.83 | 7.64 |

Figure 7:
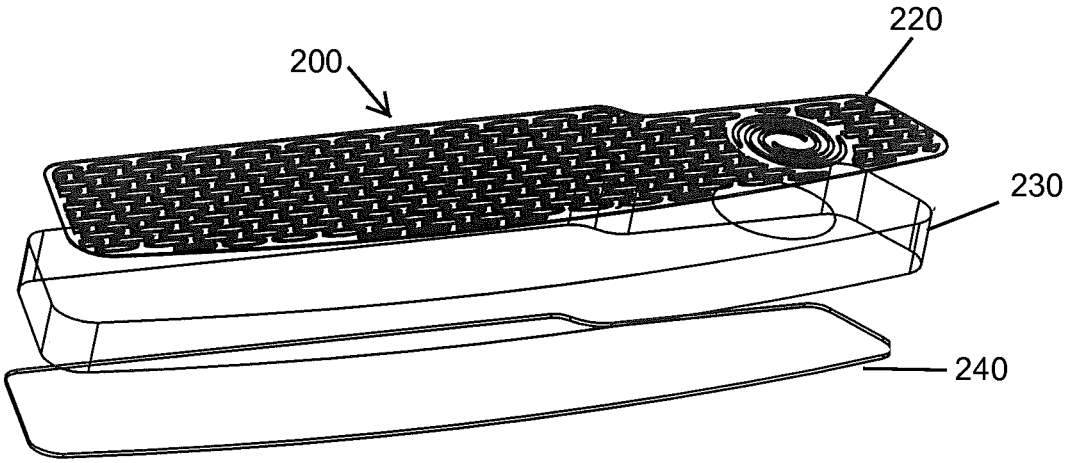
FIG. 7 is an exploded, perspective view of a second embodiment of the present invention.
Figure 8:
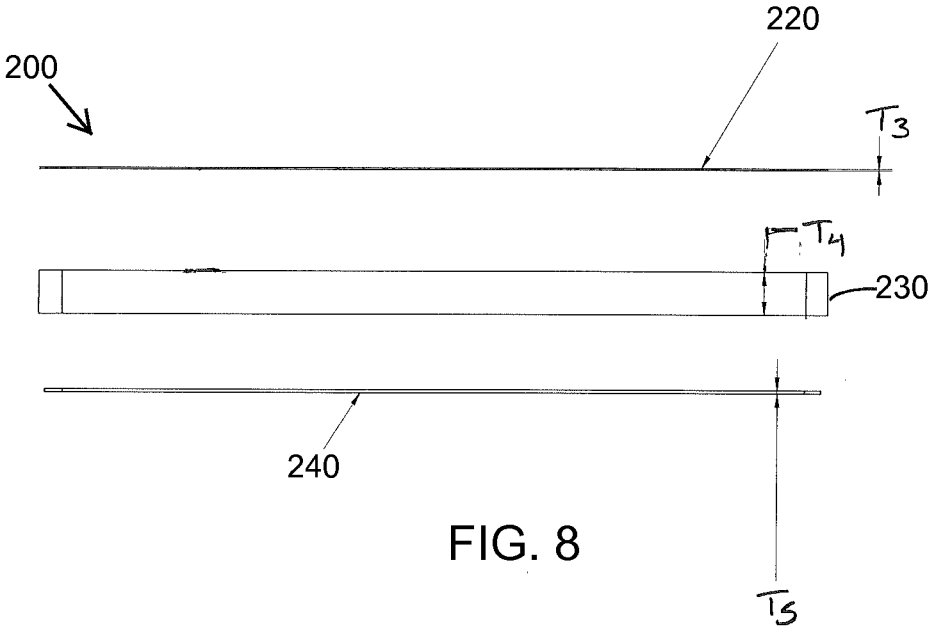
FIG. 8 is a side, plan view of the embodiment shown in FIG. 7.

A preferred embodiment of the present invention is shown in FIGS. 7-8. In this embodiment, a striking sheet 220 with a thickness $T_3$ of 0.005 to 0.020 inch, and more preferably 0.007 to 0.016, inch is permanently affixed to a urethane backing 230 with a thickness $T_4$ of approximately 0.200±0.050 inch using adhesive, preferably 3M 7533 adhesive that is applied to one or both of the striking sheet 220 and urethane backing 230 via silk screening. The striking sheet 220 includes the textured surface 22 pattern disclosed herein, with oval-shaped holes 24 having the dimensions and spacing disclosed herein. In this preferred embodiment, however, the oval-shaped holes 24 extend completely through the thickness $T_3$ of the striking sheet 220, giving the striking sheet 220 a mesh-like structure. Another adhesive layer 240 with a thickness $T_5$ of approximately 0.015±0.010 inch is then affixed to the back of the urethane backing 230, and the resulting face insert 200 is inserted into a recess in a golf club head 100 as shown in FIG. 5. This embodiment is preferred because it combines the feel of a urethane face with the improved gripping technology of a striking sheet 220 with an improved, textured surface 22, the benefits of which are demonstrated in Tables 1 and 2 and FIG. 6 herein.

In the preferred embodiment, the striking sheet 220 is composed of a metal material, which may be aluminum, steel, titanium, nickel titanium, or another lightweight, high strength material, and more preferably is composed of aluminum. In alternative embodiments, however, the striking sheet 220 may be composed of a high strength, non-metal material, such as plastic or composite. Similarly, in the preferred embodiment, the urethane backing 230 is composed of a urethane having a hardness of Shore 42D, but in other embodiments the hardness of the urethane backing 230 may range from 40D to 60D, including hardnesses of Shore 50D-55D.

In yet another embodiment, the oval patterns described herein are formed within a solid metal face of a putter using any means known to a person skilled in the art, including, but not limited to, chemical etching, electroforming, machining, and stamping. These methods may also be used to form the textured surface of any of the embodiments disclosed herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club face insert comprising:

a front surface, a back surface, and a plurality of oval-shaped holes extending into the front surface, wherein each of the plurality of oval-shaped holes has a width of 0.150 inch to 0.200 inch and a height of 0.020 to 0.060 inch.

2. The golf club face insert of claim 1, wherein the width is approximately 0.180 inch, and wherein the height is approximately 0.040 inch.

3. The golf club face insert of claim 1, wherein each of the plurality of oval-shaped holes is spaced horizontally from neighboring oval-shaped holes by 0.01 to 0.03 inch, and wherein each of the plurality of oval-shaped holes is spaced vertically from neighboring oval-shaped holes by 0.005 to 0.011 inch.

4. The golf club face insert of claim 3, wherein each of the plurality of oval-shaped holes is spaced horizontally from neighboring oval-shaped holes by approximately 0.026 inch, and wherein each of the plurality of holes is spaced vertically from neighboring holes by approximately 0.009 inch.

5. The golf club face insert of claim 1, wherein the face insert is composed of a polymer material.

6. The golf club face insert of claim 5, wherein the polymer material is a urethane.

7. The golf club face insert of claim 6, wherein the urethane has a hardness of Shore 40D to Shore 60D.

8. The golf club face insert of claim 1, wherein the face insert has a thickness of no less than 0.100 inch and no more than 0.300 inch.

9. The golf club face insert of claim 1, wherein at least one of the plurality of oval-shaped holes extends completely through the face insert.

10. A golf club head comprising:

a body comprising a top surface, a bottom surface, a heel side, a toe side, and a face recess; and a face insert comprising a plurality of oval-shaped holes, wherein each of the plurality of oval-shaped holes has a width of 0.150 inch to 0.200 inch and a height of 0.020 to 0.060 inch, wherein the face insert is sized to fit within the face recess, and wherein the face insert is secured within the face recess.

11. The golf club head of claim 10, wherein the golf club head is selected from the group consisting of a fairway head, driver head, hybrid head, iron head, and putter head.

12. The golf club head of claim 11, wherein the golf club head is a putter head.

13. The golf club head of claim 10, wherein the face insert is composed of a polymer material.

14. The golf club head of claim 13, wherein the polymer material has a hardness of Shore 40D to Shore 60D.

15. The golf club head of claim 10, wherein each of the plurality of oval-shaped holes is spaced horizontally from neighboring oval-shaped holes by 0.01 to 0.03 inch, and wherein each of the plurality of oval-shaped holes is spaced vertically from neighboring oval-shaped holes by 0.005 to 0.011 inch.

16. The golf club head of claim 15, wherein each of the plurality of oval-shaped holes is spaced horizontally from neighboring oval-shaped holes by approximately 0.026 inch, and wherein each of the plurality of holes is spaced vertically from neighboring holes by approximately 0.009 inch.

* * * * *